US006341391B1

(12) United States Patent
Cheng

(10) Patent No.: US 6,341,391 B1
(45) Date of Patent: Jan. 29, 2002

(54) HIDDEN DRAIN OUTLET STRUCTURE FOR SINK

(76) Inventor: Tsan-Hsiung Cheng, 3003 Beach Dr., Tampa, FL (US) 33629

( * ) Notice: Subject to any disclaimer, the term of this patent is extended or adjusted under 35 U.S.C. 154(b) by 0 days.

(21) Appl. No.: 09/755,043

(22) Filed: Jan. 8, 2001

(51) Int. Cl.[7] ..... E03C 1/23
(52) U.S. Cl. ..... 4/689; 4/688; 4/287
(58) Field of Search ..... 4/689, 690, 691, 4/692, 693, 688, 684, 683, 682, 652, 653, 668, 287, 288

(56) References Cited

U.S. PATENT DOCUMENTS 1,195,827 A * 8/1916 Lucke ..... 4/689
1,671,134 A * 5/1928 Speakman ..... 4/683
2,989,758 A * 6/1961 Turek et al. ..... 4/684
3,314,083 A * 4/1967 Minella ..... 4/692
3,314,085 A * 4/1967 Minella ..... 4/689
3,314,086 A * 4/1967 Minella ..... 4/689
3,465,372 A * 9/1969 Reagan ..... 4/693
5,509,150 A * 4/1996 Bergmann et al. ..... 4/691

* cited by examiner

*Primary Examiner*—Gregory L. Huson
*Assistant Examiner*—Huyen Le
(74) *Attorney, Agent, or Firm*—Dougherty & Troxell

(57) ABSTRACT

An improved hidden drain outlet structure for sink includes a drain pipe, a drain head screwed to the drain pipe at an upper end thereof and a filter movably screwed to the drain head. The filter may trap and collect external articles and garbage to prevent the drain pipe from clogging, and may be disassembled easily for repairs. The drain head and filter form a double curve-shaped top surface with a converged valley to facilitate water discharging and form a sturdy and safe construction and has aesthetic appearance.

3 Claims, 6 Drawing Sheets

HIDDEN DRAIN OUTLET STRUCTURE FOR SINK

FIELD OF THE INVENTION

This invention relates to an improved hidden drain outlet structure for sink and particularly a hidden drain outlet structure that may be disassembled easily for cleaning and repairs, and is capable of discharging water smoothly without clogging the drain pipe.

BACKGROUND OF THE INVENTION

The conventional drain outlet structure of a sink (as shown in FIG. 1) mostly has a control bar for lifting a plunger up or down when in use. The control bar sticks out from the drain pipe for a significant distance. The plunger head will be moved up above the basin bottom when draining water. It is easy to suck in foreign articles or garbage and block the drain pipe. The construction is rough and lacks aesthetic appealing. In view of these disadvantages, there are some refinements and improvements been developed. U.S. Pat. No. 5,509,150 (shown in FIG. 2) is one of the examples. It has a hidden drain feature which includes a drain pipe 10 connects with an outlet of the sink 1. In the drain pipe 10, there is a movable plunger 11 controlled by a pull rod 12 for moving up to drain water or moving down to retain water. At the top end of the pipe 10, a stationary disk 13 is provided for trapping foreign articles and garbage. Although it has a more appealing look than the conventional drain features, it has some disadvantages. For instance, the stationary disk 13 is fixed and cannot be removed. If the drain pipe 10 is clogged, the whole set of the drain pipe 10 has to be disassembled from under for doing the repairs job. It is very inconvenient and time consuming. Furthermore, as water discharge always forms a vortex at the outlet, the substantially flat top of the stationary disk 13 significantly slows down water discharge speed. Its fixed stationary disk 13 design also cannot match with most filtering articles now available in the market place that are designed for conventional sinks and drain features. There is still room for improvement.

SUMMARY OF THE INVENTION

It is therefore an object of this invention to provide an improved hidden drain outlet structure for sinks that has a drain head screwed to the upper end of a drain pipe. The drain head may engage with a filter which is easy to disassemble for repairs and maintenance. It is also capable of discharging water smoothly without clogging the drain pipe.

BRIEF DESCRIPTION OF THE DRAWINGS

The invention, as well as its many advantages, may be further understood by the following detailed description and drawings, in which.

DESCRIPTION OF THE PREFERRED EMBODIMENT

This invention aims at providing an improved hidden drain outlet structure for sinks that may be disassembled easily for cleaning and repairs, and is capable of discharging water smoothly, and is sturdily constructed and durable, and has aesthetic look and may be used safely.

Figure 1:
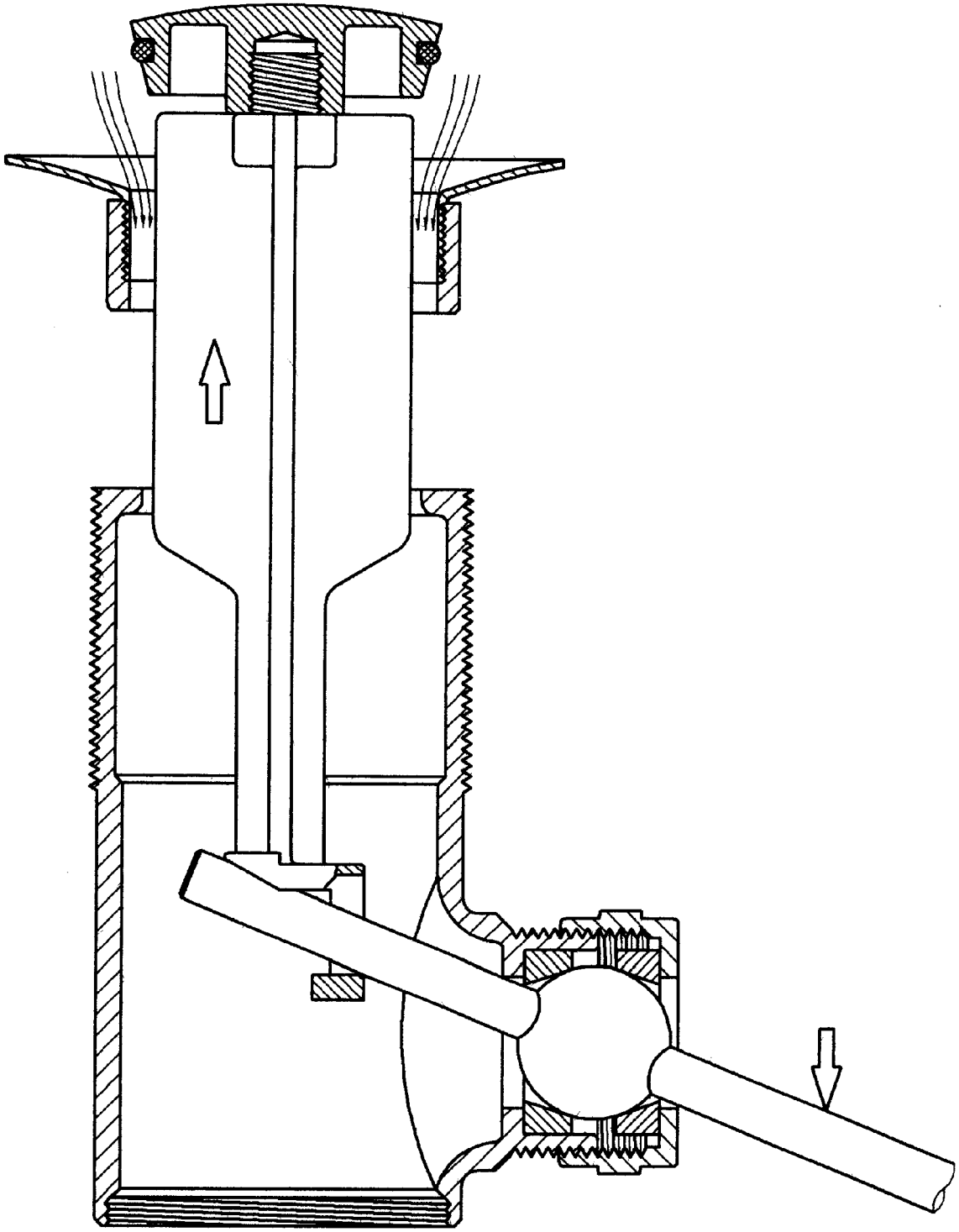
FIG. 1 PRIOR ART
FIG. 1 is a schematic sectional view of a conventional drain feature for a sink.
Figure 2:
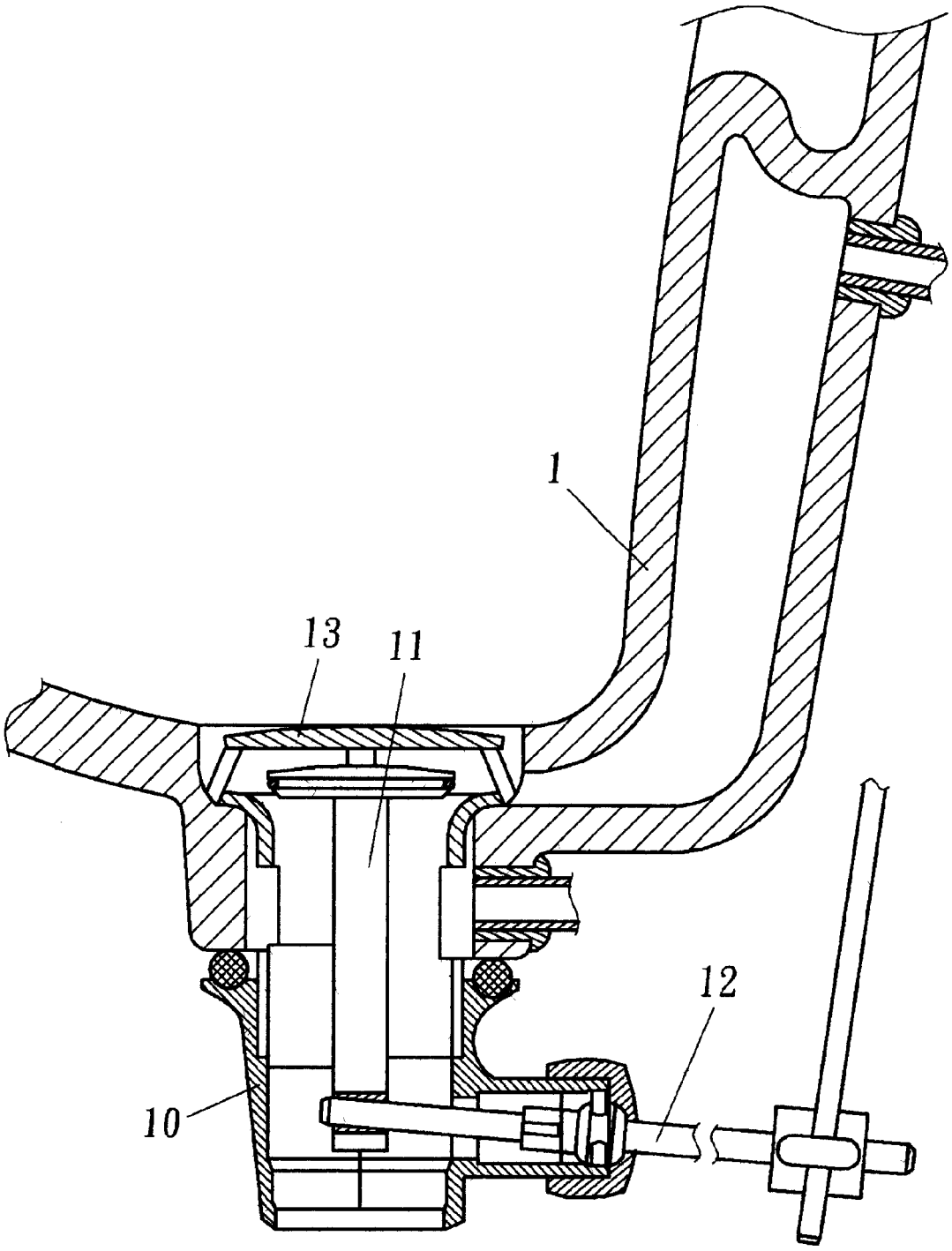
FIG. 2 PRIOR ART
FIG. 2 is another schematic sectional view of a conventional drain feature for a sink.
Figure 3:
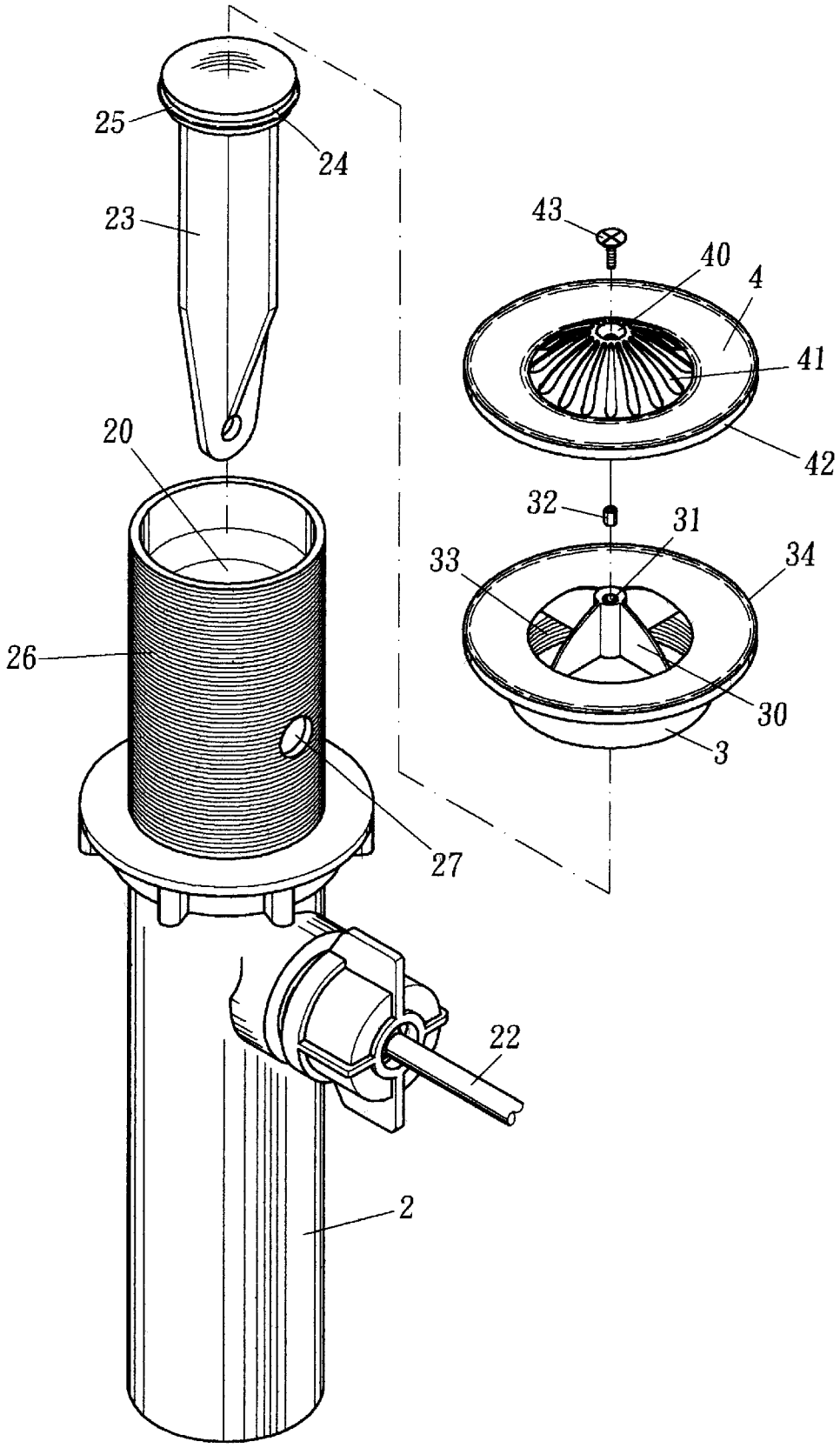
FIG. 3 is an exploded view of this invention.
Figure 4:
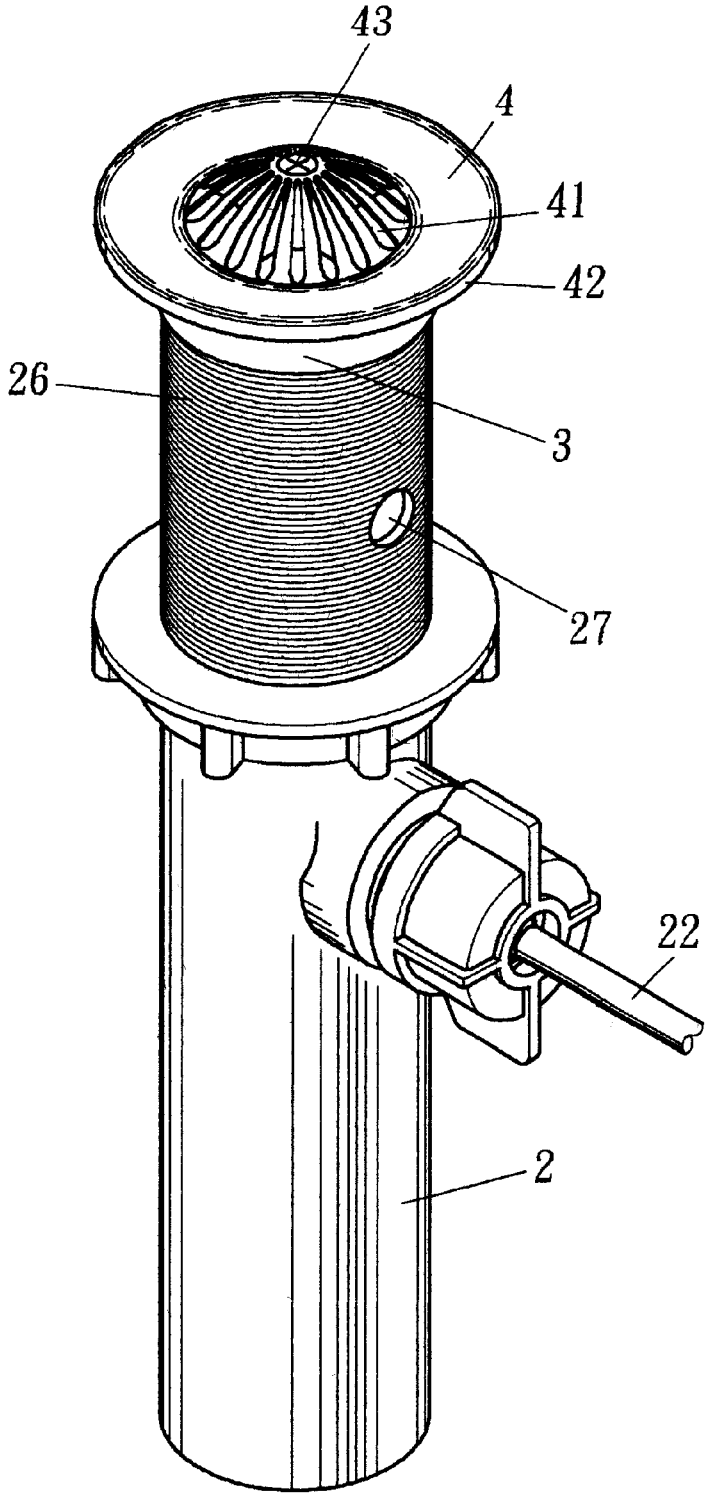
FIG. 4 is a perspective of this invention.

Referring to FIGS. 3 and 4, the drain outlet structure according to this invention includes a drain pipe 2 which has drain passage 20 formed therein. At the upper section of the drain passage 20, there is a neck section 21 which has a smaller diameter and has a slant inside wall (shown in FIG. 5). At one side of the drain pipe 2, there is a control bar 22 run through the side wall of the drain pipe 2 and has one end disposed inside the drain passage 20 for engaging with a lower end of a plunger 23. The plunger 23 is movable in the drain passage 20 and has a plunger flange 24 located at the top end. There is a seal ring 25 engages with the circumference of the plunger flange 24. When the plunger 23 is moved downward, the plunger flange 24 and seal ring 25 will also be moved downward to engage with the neck section 21 to seal the drain outlet. The drain pipe 2 further has external screw threads 26 formed at the outer wall and an overflow outlet 27 formed at a selected location. Above the drain pipe 2, there is a drain head 3 screwed with the top end of the drain pipe 2. The drain head 3 is hollow and has a plurality of reinforced curved ribs 30 located inside. The ribs 30 join in the center to form a juncture which has an aperture 31 for holding a screw nut 32 therein. The drain head 3 further has internal screw threads 33 for engaging with the external screw threads 26 of the drain pipe 2. The periphery of the drain head 3 forms an annular ring 34 which has an arched surface tilted slightly upward. The arched annular ring 34 and curved ribs 30 form a double curved sectional profile and form a valley in a middle section (shown in FIG. 5).

There is further a circular filter 4 located above the drain head 3. The filter 4 forms like a disk which has a recess through hole 40 in the center for fastening to the screw nut 32 through a screw 43. The filter 4 has a plurality of water-drop-shaped discharge slots 41 extended outward radially from the through hole 40. At the outer periphery away from the slots 41, the filter 4 has an annular rim 42 bent downwardly then to engage with the annular ring 34 of the drain head 3. Thus form the completed assembly of this invention which may be disposed at the bottom of the sink and has a smooth surface for reducing water flow resistance. All the aforesaid elements may be made from plastics or metallic material.

Figure 5:
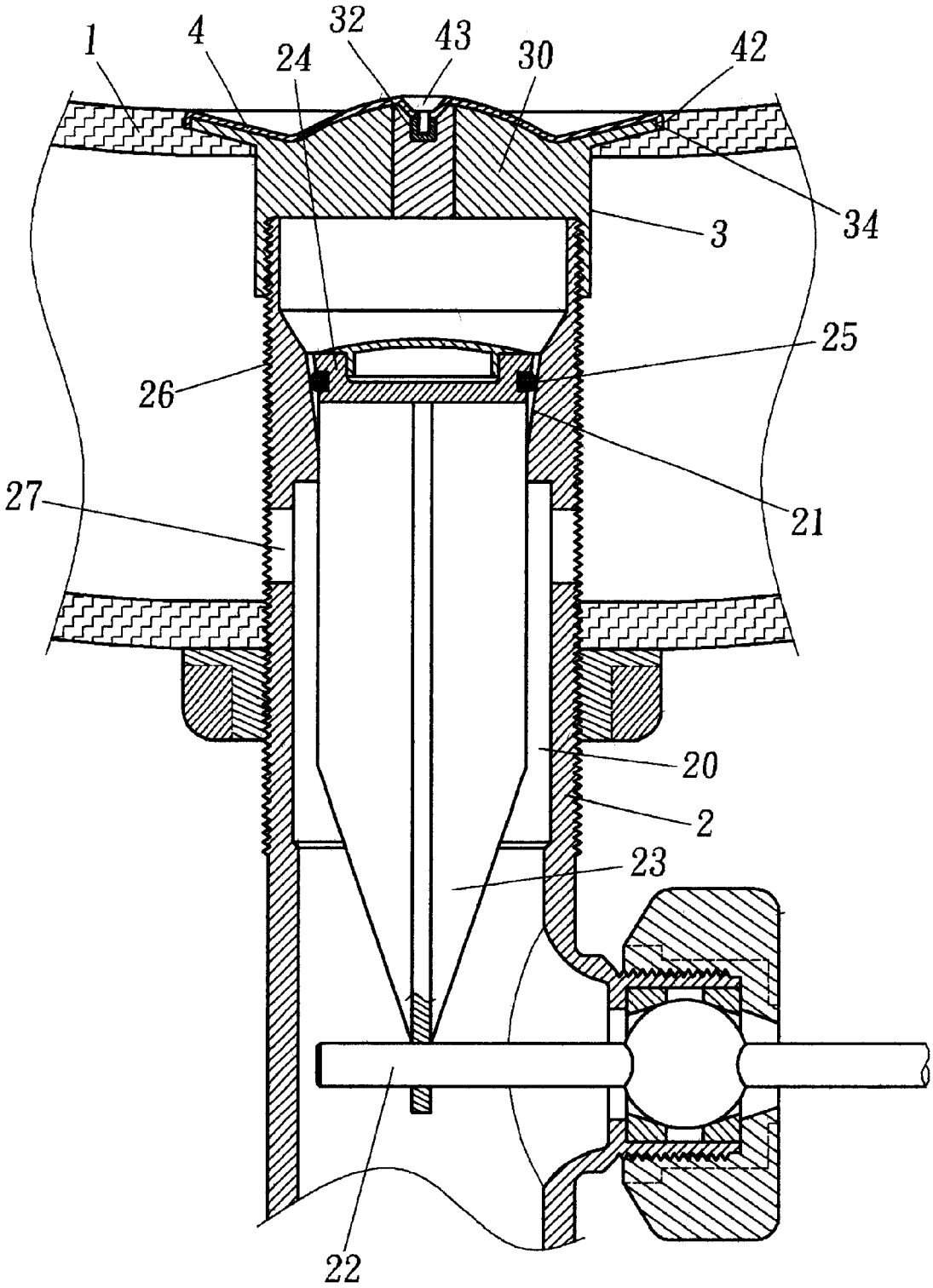
FIG. 5 is a sectional view of this invention in use for retaining water.
Figure 6:
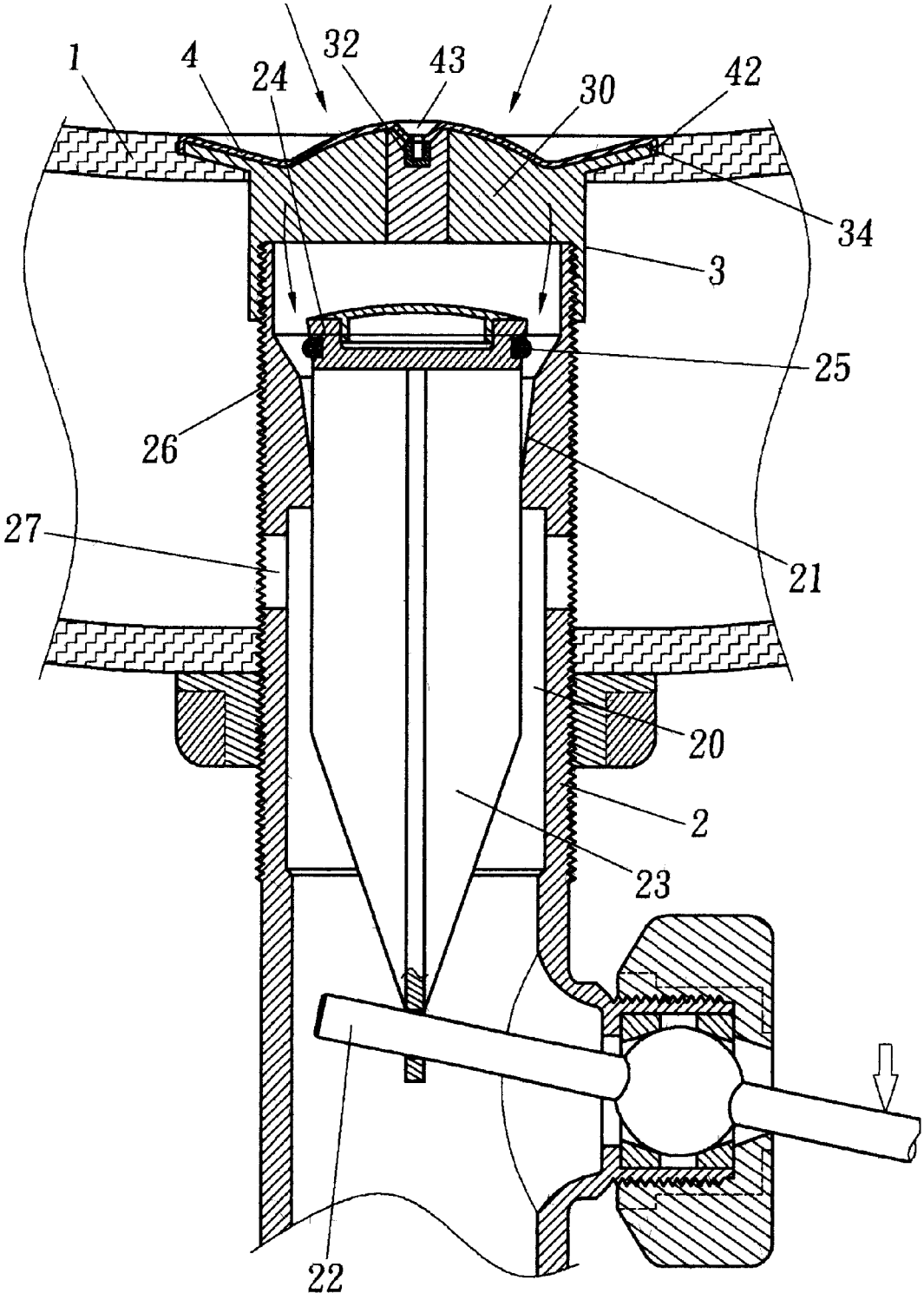
FIG. 6 is a sectional view of this invention in use for draining water.

Referring to FIG. 5, when this invention is in use, the drain pipe 2 is fastened to the bottom of the sink 1 (installation technique is known in the art and will be omitted herein). Move the control bar 22 downward, the plunger 23 will also be moved downward, the plunger flange 24 will engage with the slant inside wall of the neck section 21 to stop water from flowing down and water will be retained in the sink 1. Referring to FIG. 6, when the control bar 22 is moved upward, the plunger 23 will be moved upward. The plunger flange 24 will be lifted and moved away from the neck section 21, then water will be discharged out from the slots 41 of the filter 4 through the drain head 3 and drain passage 20.

The structure of this invention has the following advantages:

1. The filter may trap and collect debris and other foreign articles such as hairs, contact lens, artificial tooth, ring or the like from flowing into the drain pipe and may prevent the drain pipe from clogging.

2. The filter is removable and may be replaced easily when damaged. Even if the drain pipe is clogged, the filter may be removed from the top end easily and to clear the clogged pipe conveniently.

3. The double curve shape of the filter and drain head enables forming discharging vortex for water flow to be drained quickly.

4. The filter and drain head engage snugly. The reinforced ribs further provide the filter additional support. Hence the filter may withstand more pressure without denting or damage.

5. The filter has a smooth rim to cover the slant annular ring of the drain head, and may prevent people from injury or hurting.

6. All the elements of this invention may be made from plastics or metallic material. They are relatively low costs and light weight, and are easy to carry for repairs and replacement.

7. The discharge slots in the filter may be made in various forms and sizes desired. It may add aesthetic appealing and to trap all kinds of foreign articles.

It may thus be seen that the objects of the present invention set forth herein, as well as those made apparent from the foregoing description, are efficiently attained. While the preferred embodiment of the invention has been set forth for purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. An improved hidden drain outlet structure for sink, comprising:

a drain pipe having external screw threads, a drain passage located inside, a neck section located at an upper portion of the drain passage having a slant inside wall forming a smaller diameter than the drain passage, a plunger moveably located in the drain passage and a control bar having one end engaging with the plunger, the plunger having a plunger flange located at the top end thereof and a seal ring engaging with the circumference of the plunger flange;

a hollow drain head having internal screw threads for engaging with the external screw threads of the drain pipe, a plurality of reinforced curved ribs located at the top end thereof and an annular arch-shaped ring formed at the periphery which has an outer rim tilted upward, the ribs joining in the center at a juncture and having an aperture formed in the juncture for holding a screw nut therein; the aperture and outer rim being at a higher level than other portion of the annular ring for the upper side of the drain head to form a double curved slope converged in the middle portion to form a valley; and a filter located above the drain head and formed substantially in a circular disk mating with the upper side of the drain head and having a recess through hole in the center for engaging with the screw nut through a screw, a plurality of water discharge slots extended outward from the through hole, and an annular rim to engage with the annular ring of the drain head.

2. The improved hidden drain outlet structure of claim 1, wherein the drain pipe and drain head can be made from plastics.

3. The improved hidden drain outlet structure of claim 1, wherein the discharge slots are formed in various selected sizes and shapes.

* * * * *